United States Patent [19]

Biebuyck

[11] Patent Number: 4,899,508

[45] Date of Patent: Feb. 13, 1990

[54] PANEL AND GLASS CURTAIN WALL SYSTEM

[75] Inventor: Lawrence Biebuyck, Garland, Tex.

[73] Assignee: Butler Manufacturing Company, Kansas City, Mo.

[21] Appl. No.: 242,461

[22] Filed: Sep. 9, 1988

Related U.S. Application Data

[63] Continuation-in-part of Ser. No. 187,551, Apr. 28, 1988, abandoned.

[51] Int. Cl.[4] ..... E04B 2/88

[52] U.S. Cl. ..... 52/235; 52/509; 52/656

[58] Field of Search ..... 52/235, 397–399, 52/400, 477, 506, 509, 656, 741

[56] References Cited

U.S. PATENT DOCUMENTS

| | | | |
|---|---|---|---|
| 2,949,981 | 8/1960 | Ferrel | 52/235 |
| 3,478,480 | 11/1969 | Swenson | 52/235 X |
| 3,936,986 | 2/1976 | Steel | 52/235 |
| 3,978,629 | 9/1976 | Echols, Sr. . | |
| 4,009,549 | 3/1977 | Hala | 52/477 X |
| 4,021,989 | 5/1977 | Hala . | |
| 4,055,923 | 11/1977 | Biebuyck . | |
| 4,194,333 | 3/1980 | Paton et al. . | |
| 4,307,551 | 12/1981 | Crandell . | |
| 4,519,173 | 5/1985 | Roberts . | |
| 4,633,631 | 1/1987 | Crandell | 52/235 |
| 4,644,717 | 2/1987 | Biebuyck . | |
| 4,773,193 | 9/1988 | Biebuyck et al. . | |
| 4,783,941 | 1/1988 | Loper et al. | 52/235 |

FOREIGN PATENT DOCUMENTS

| | | | |
|---|---|---|---|
| 1289289 | 2/1969 | Fed. Rep. of Germany | 52/235 |
| 1293557 | 4/1962 | France | 52/235 |

*Primary Examiner*—Richard E. Chilcot, Jr.
*Attorney, Agent, or Firm*—Johnson & Gibbs

[57] ABSTRACT

A building system integrating the combination of aluminum and steel structural elements for the efficient assembly of stone and glass panels in a curtain wall system which is conspicuous for its lack of a grid appearance. A plurality of discrete steel clips are utilized for securing stone panels to supporting mullions. A plurality of aluminum members are secured to structural mullions whereby glass may be mounted thereto. The stone and glass panels are sealably secured adjacent one another while a glazing adapter is constructed for assembly over the structural mullions there behind. A splice facilitates mating engagement of the aluminum mullions to permit relative movement therebetween. In this manner, both steel and aluminum may be utilized most efficiently for the assembly of stone and glass panels in a curtain wall system with improved structural and aesthetic qualities.

21 Claims, 9 Drawing Sheets

PANEL AND GLASS CURTAIN WALL SYSTEM

BACKGROUND OF THE INVENTION

CROSS REFERENCE TO RELATED APPLICATIONS

This application is a Continuation-In-Part of U.S. Pat. application Ser. No. 07/187,551, filed on Apr. 28, 1988, now abandoned.

FIELD OF THE INVENTION

The present invention pertains to building systems and, more particularly, to a building system integrating the combination of steel and aluminum elements for the efficient assembly of stone and glass panels in a common curtain wall system which is conspicuous for its lack of grid appearance.

HISTORY OF THE PRIOR ART

The prior art is replete with structural building materials and techiniques dating back into technological antiquity. These structural systems generally incorporate a plurality of vertical, load bearing members, and/or wall sections adapted for supporting siding and/or panels disposed outwardly thereof. Panels of various types and thicknesses are used to form an enclosure section either of the store front or the curtain wall variety. Typically both vertical and horizontal mullions are incorporated for the support thereof. Obviously, the type of material used in the wall panel has a direct bearing upon the manner of support. Other structural considerations include coefficients of expansion of the wall panel material, dynamic, and static loading thereon, sealing, and suspension aspects therearound.

One of the most popular curtain wall designs in contemporary building is that of contiguous panels such as glass. The glass panels may be in single or multiple pane configurations. Major considerations in the use of panels are, of course, structural integrity, aesthetics, and the sealing against fluid and drainage of fluid that has infiltrated the panels. Sources of intruding fluid include rainwater and window washing residue which can leak past panel gripping gaskets. This is discussed in detail in U.S. Pat. No. 4,644,717, assigned to the assignee of the present invention. Another source of intruding fluid is condensation from moisture within horizontal mullions. Intruded water which is in the portion of the mullions that are under the panels can be disposed of fairly readily. This is done by means of weep holes and the like formed in mullions which are generally of the extruded aluminum variety.

In such a discussion it is necessary to compare the structural technology of glass curtain wall systems as compared to other assemblies. A glass curtain wall system is set forth and described in U.S. Pat. No. 4,055,923, which issued on Nov. 1, 1977. This system was invented by the applicant herein as was the aforementioned U.S. Pat. No. 4,644,717. Heavier wall panel sections are described in U.S. Pat. No. 4,194,333 which issued on Mar. 5, 1980. The latter patent teaches an attachment for a precast concrete wall panel to a building in a manner which permits vertical movement of the wall panel relative to building structural elements. Such considerations are obviously important for proper structural integrity in both systems.

Precast concrete wall panels are widely used in the building industry. They can be custom made which may prove to be very expensive and inefficient. They can also be formed in an automated process. However, there are numerous considerations in the use of such panels. Their size sometimes prohibit their use in congested downtown areas due to code restrictions and the like. Moreover, stone panels on precast backers are difficult to replace and the means for attaching those panels to the building structure is difficult. Column spacing can also become a cumbersome design parameter. The attachment technique for the panels must be efficient from a labor standpoint yet secure enough to safelyu withsatand all the stresses to which a building is subjected. One of the most important considerations is movement of the building elements relative to each other. Such relative movement is an especially important factor in areas of high windloads.

Other exterior building and cladding systems are set forth and shown in the following U.S. patents: U.S. Pat. No. 4,021,989 issued to Alfred Hala teaches a rotatably pivotal stone anchor and stone anchor construction system as one means for a stone construction system. As stated therein, the basic problem in stone or concrete clad construction is the securement of the stone in position which requires the securement of anchors to the stone. As set forth in this and other references, provision of anchoring construction systems which allow lateral adjustment with respect to the inner frame of the wall and which is capable of pivotal movement about a vertical plane for simplifying the securement of the stone to the frame is important. Stone anchor construction systems employing expansion type anchor bolts and the like are thus commonplace. Such anchor means, however, do not comprise the standard constructional elements of lightweight curtain wall systems of the solid glass variety. As even more clearly set forth in the Roberts U.S. Pat. No. 4,519,173, issued May 28, 1985 for a "slab" (stone panel) hanging system, the stone panel supporting hanger devices must be mounted on the column members and utilize a securement system very dissimilar to glass curtain wall structures. With such stone panel supporting systems, the stone panels must be removable yet integral in the sense that their various components and features cooperate to achieve the proper alignment and positioning of the stone panels one with the other.

Another Hala patent, U.S. Pat. No. 4,009,549 issued in Mar. 1977 teaches a system and method of fabricating preformed intermediate structural strut members for connecting the extra masonry facing to the structural frame of an edifice. Again stone anchors or clips are utilized with structural strut members acting as skeleton members and which have provision for the direct securement of a building component thereto. It should be apparent from review of such prior art references that the cost of erecting facings to the buildings is very substantial and improvements in the efficiency thereof would be an important advance in the prior art.

As stated above, glass curtain walls are generally constructed of extruded aluminum members and steel mullions. The various components of the wall system are fabricated at the factory and transported to the job site. The vertical and horizontal members are constructed in predetermined shapes and lengths and assembled piece by piece onto a building grid. Unfortunately, the uniformity in shape of the steel mullions is often not acceptable from an aesthetic standpoint. Aluminum covers are often used therewith. When the steel mullions are not exactly formed, they may be usable structurally, but prefabricated aluminum covers and the fittings, therefore, often fail to match.

An integrated system with efficient versatility in use with both stone panels and glass and which accommodates inexactitude in steel mullion shape does not, in and of itself, appear as an available alternative in the prior art. The combination is, however, desirable since more conventional buildings are now often custom designed to incorporate these opposite panel types in a single structure. It would be an advantage therefore, to provide a single building system which could accommodate the irregularities of steel fabrication in an aluminum and steel assembly for glass and stone panels.

The present invention overcomes the disadvantages of the prior art by providing in a single system a glass and stone panel curtain wall building system capable of providing an efficient integrated assembly with a pivotal, double convex glazing adaptor. The assembly is also afforded by utilizing the heavier foundations of a structural steel framework with a plurality of separate structural steel clips configured for supporting the heavy stone panels and securement with lighter weight extruded aluminum sections. Aluminum mullions are typically found in glass curtain wall systems. The present invention also facilitates the integration of the glass and stone panel assemblies with a support system that can be adapted to a myriad of stone and glass panel configurations. In this manner, a curtain wall system can be implemented which is conspicuous for its lack of a grid appearance, yet feasible for either solid glass, solid stone and/or combinations therebetween. This can be done without a great modification to either the structural parts of the building or the aesthetic panels thereof.

SUMMARY OF THE INVENTION

The present invention relates to a stone and glass curtain wall system with a glazing adapter for accommodating irregularities in the structural steel mullions thereof. More particularly, one aspect of the present invention includes a combination stone and glass curtain wall secured by a combination of steel and aluminum in a cost effective, structurally sound, efficient assembly. A plurality of genrally vertical steel mullions support a plurality of horizontal steel clips secured to the vertical mullions in generally parallel spaced relationship. Steel is stiffer than aluminum and the design constraint for the deflection limit of the wall is easily met. Since steel can meet the specifications in shallower sections, less aluminum can be used. A pivotal glazing adaptor with a double convex mounting section then makes it possible to use aluminum covers over steel parts for aesthetic purposes. A plurality of horizontal aluminum mullions are also secured to the vertical steel mullions in generally parallel spaced relationship one to the other and in generally orthogonal relationship to the steel mullions. At least some of the aluminum mullions are adapted for the securement of glass thereto. The aluminum mullions are disposed adjacent the separate, or discrete horizontal steel clips in generally parallel spaced relationship for the securement of glass in direct association with the stone. A specifically configured mullion splice is also incorporated to allow for expansion and contraction of the horizontal mullion without imparting stress. This is key to an efficient and safe integration system between stone and glass.

In another aspect, the curtain wall described above also includes means for sealably securing the heavier stone and the lighter glass adjacent one another with a frontal face formed in the horizontal aluminum mullion adapted for receiving a cap thereacross. The cap is disposed in relatively flush, edgewise, abutting engagement with the stone and secured to the mullion securing the glass therein. The horizontal mullion comprises at least one hollow region therein for the collection of water and the elimination of water therethrough. The frontal face is constructed with at least one aperture permitting the drainage of water therefrom and the sealant means comprises an elastomeric sealant bonded directly to an edge of the stone into an edge of the cap secured to the mullion. This is a marked advance over conventional precast concrete systems which are expensive and, yet, subject to human error.

In yet another aspect, the invention includes an improved method of manufacturing a glass and stone panel curtain wall of the type wherein both glass and stone panels are secured to a common curtain wall with the glass panels being disposed adjacent the stone panels in at least one select area thereof. The improvement comprises the steps of providing a structural framework including a plurality of vertical steel mullions disposed in generally parallel spaced relationship one from the other. A plurality of horizontal steel clips are provided and adapted for supporting the stone panels and the securement thereof to the vertical steel mullions. The horizontal steel clips are secured to the vertical steel mullions. A plurality of horizontal, aluminum mullions are provided for securement to the steel mullions and the support of the glass panels. The horizontal, aluminum mullions are secured to the vertical steel mullions in generally parallel spaced relationship and in an orientation generally orthogonal to the vertical steel mullions. The stone panels are then mounted to the horizontal steel clips and the glass panels mounted to the horizontal, aluminum mullions.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
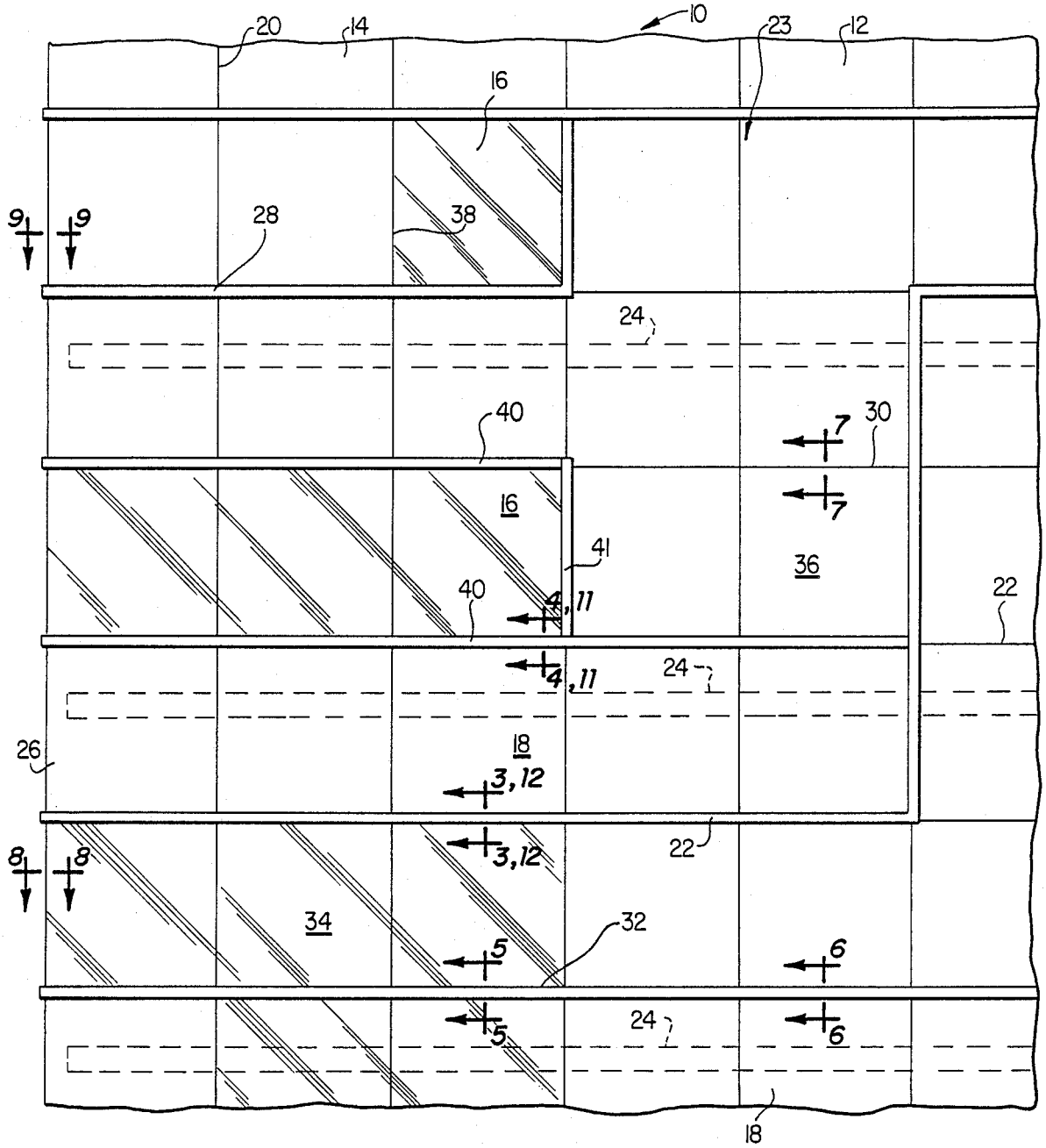
FIG. 1 is a front-elevational view of a stone and glass curtain wall assembly constructed in accordance with the principles of the present invention.

Referring to first to FIG. 1, there is shown a side-elevational view of a stone and glass curtain wall system 10 constructed in accordance with the principles of the present invention. System 10 comprises a substantially planar wall 12 constructed with a combination of heavy and relatively lighter panels 14 disposed in side-by-side relationship. The assembly 10 can use steel and/or aluminum mullions. The use of a vertical steel mullion system, which is more rigid than aluminum for a given size, enables the system to meet specifications in shallower sections wherein less aluminum is used. A glazing adaptor is therein provided making it possible to use aluminum covers over the vertical steel mullions, despite shape irregularities in the steel. A dual structure horizontal assembly of steel clips (for supporting stone panels) and aluminum mullions for supporting glass panels provides a replacement for lengthy horizontal steel mullions therein providing an assembly which is conspicuous in its lack of a grid appearance. The design of the system 10 further facilitates flexibility in the construction by alleviating scheduling problems due to the support and assembly techniques provided therein. Use of a horizontal T-splice system, which is described below for the horizontal mullions facilitates thermal expansion within the system without a build up of stress which is an integral element in the design. Moreover, a thermal flange is used as a separate item and not part of the horizontal mullion extrusion which saves both material and labor. The above are aspects of the system 10 which will be described in more detail below.

In the present embodiment, and for purposes of illustration only, the panels 14 may include glass panels 16 and heavier stone panels 18. The various glass and stone panels 16 and 18, respectively, are distributed in various configurations herein for purposes of illustrating the structural inter-relationship therebetween. One common aspect of the present invention is the vertical and horizontal alignment of the various panels 14, irrespective of the material of which they are made. A plurality of vertical and horizontal lines 20 and 22, respectively, are presented in an orthogonal relationship wherein there is constructed a "square" matrix 23. It should be noted, however, that the assembly is in accordance with the principles of the present invention, conspicuous in its lack of a grid appearance. This is because aluminum horizontal mullions, necessary for glass panels 16, can be located at any position. Their assembly with stone panels 18 is not dependent upon any mullion spacing because discrete steel clips are used therewith. The panels 16 and 18 conceal the construction therebeneath as well as the individual floors 24 of the building. The floors 24 are seen to terminate at the corner 26 of the building, which termination area will be defined detail below.

Still referring to FIG. 1, the square panel matrix 23 is made up of a plurality of corner panel intersections 28 which form the intersection of a plurality of material arrays. For example, a single stone panel may intersect three glass panels or vice versa. The assembly 10 of the present invention must be capable of accommodating such a myriad of structural interconnections for the appropriate aesthetic appearance. In accordance therewith, there are various lines of intersection 30 which comprise horizontal areas between individual stone panels 18. The structural interconnection thereof will be described in more detail below. Likewise, lines of intersections 32 are defined for the horizontal areas between adjacent glass panes which again require a different structural interconnection. There are literally a myriad of combinations. Region 34 is comprised of contiguous glass panels 16 while region 36 is comprised of contiguous stone panels 18. The vertical intersection between glass and stone in area 38 is also addressed. Each of these areas require different considerations for proper structural support in the system 10 and the sealing thereof.

The present invention is adapted for versatility in stone and glass curtain wall design. Structural and/or aesthetic members such as horizontal caps 40 can be utilized for decorative and/or sealing purposes. Glass panels can be replaced with stone and mullion designs can be varied throughout. In this regard the caps 40 are subject to being disposed either across solid glass regions 34, solid stone regions 36, and combinations thereof. The curtain wall system 10 accommodates each of these structural considerations while providing an aesthetically pleasing outer appearance. As described in more detail below, the system 10 is integrally sealed against water infiltration although a myriad of materials are utilized. An example of the structural and functional considerations include the variations in thermal coefficient of expansion between glass and stone, the obvious differences in weight and the means for support thereof, the loading characteristics and the uneven loading upon the substructure that such variations in design manifest.

Figure 2:
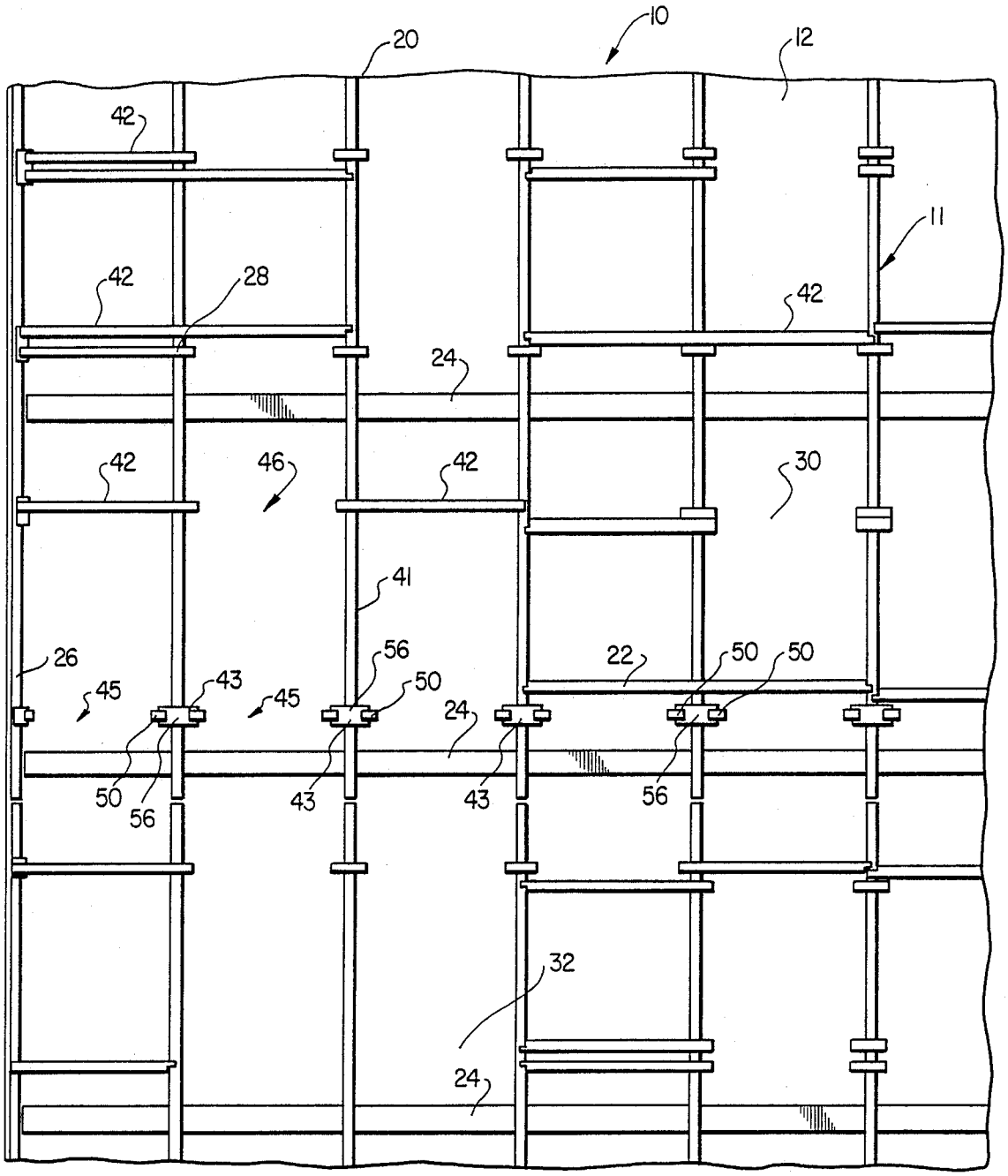
FIG. 2 is a front-elevational view of the curtain wall assembly of FIG. 1 with the stone and glass panels removed illustrating the structural framework thereof.

Referring now to FIG. 2, there is shown the underlying framework 11 for the curtain wall system 10 affording the constructional aspect described with respect to FIG. 1. The granite and glass panels illustrated in FIG. 1 have been removed to illustrate the vertical and horizontal structure in support of the glass and stone panels of the wall 12. The floors 24 are revealed in this view as are the intersecting points 28 forming the corners between contiguous panels. It may be seen that the horizontal aluminum extrusions of the curtain wall system used for support of the glass panels 16 are deleted from this view so that only the steel framework 11 is shown. Illustrations of particular extruded aluminum mullions secured to the underlying steel frame 11 for support of the glass panels 16 are shown in other drawings and will be described in more detail below.

Still referring to FIG. 2, there is shown an array of generally parallel spaced, vertical steel mullions 41 and horizontal struts 42 secured therebetween in generally orthogonal relationship therewith. It may be seen that each of the horizontal struts 42 is located to accommodate a particular stone panel or panel array. Likewise, a plurality of separate support clips 43 (herein referred to as "discrete" clips because they are secured to single vertical mullions) are provided for coupling with curfs formed in the edges of stone panels 18. Spaces 45 are thus created between adjacent clips 43 as well as a space 46 created between adjacent underlying stone support struts 42. Numerous assembly techniques can be incorporated with discrete clips 43 in accordance with the principles of the present invention. For illustration purposes, some panel support sections may incorporate select variations in position relative to adjacent steel frame members. The design may thus be seen to afford great versatility in providing a curtain wall system adapted for both stone and glass panels.

Addressing now the specific structural aspects of the present invention, attention will be drawn to various cross-sections of the curtain wall system of FIG. 1. These illustrations are to permit a complete explanation of the system 10. For example, referring to FIG. 4, there is shown an enlarged, side-elevational, cross-sectional view of an intermediate section of the curtain wall system 10 of FIG. 1 taken along lines 4—4 thereof. An upper glass panel 16 is disposed above a granite panel 18 with a cap 40 covering the notional plane of intersection therebetween. The vertical mullion 41 is shown with attachment supports for both the glass 16 and granite 18. The attachments for the granite 18 comprises a generally C-shaped expansion clip 50, which includes a first flange section 52 that abuttingly engages a flange section 54 of the vertical steel mullion 41 with a support clip 56 disposed therebetween. The expansion clips 50 are shown secured to support clips 56 in FIG. 2. The clips are preferably made of steel and of sufficient size to support the stone 18. Threaded fasteners 58 are utilized for mounting the steel clips, which threaded fasteners may comprise conventional nut and bolt members. The clip 50 is shown to extend outwardly from the steel mullion 41 and the support clip 56 to the outside edge of granite panel 18. A lip 60 of the clip 50 engages a curf or groove 62 formed in the side wall of the granite section. This is also shown in more detail below. In this way the granite section is held against lateral movement while a degree of vertical movement is facilitated. Such movement is necessary for absorbing deflections of the floor slabs 24.

Figure 4:
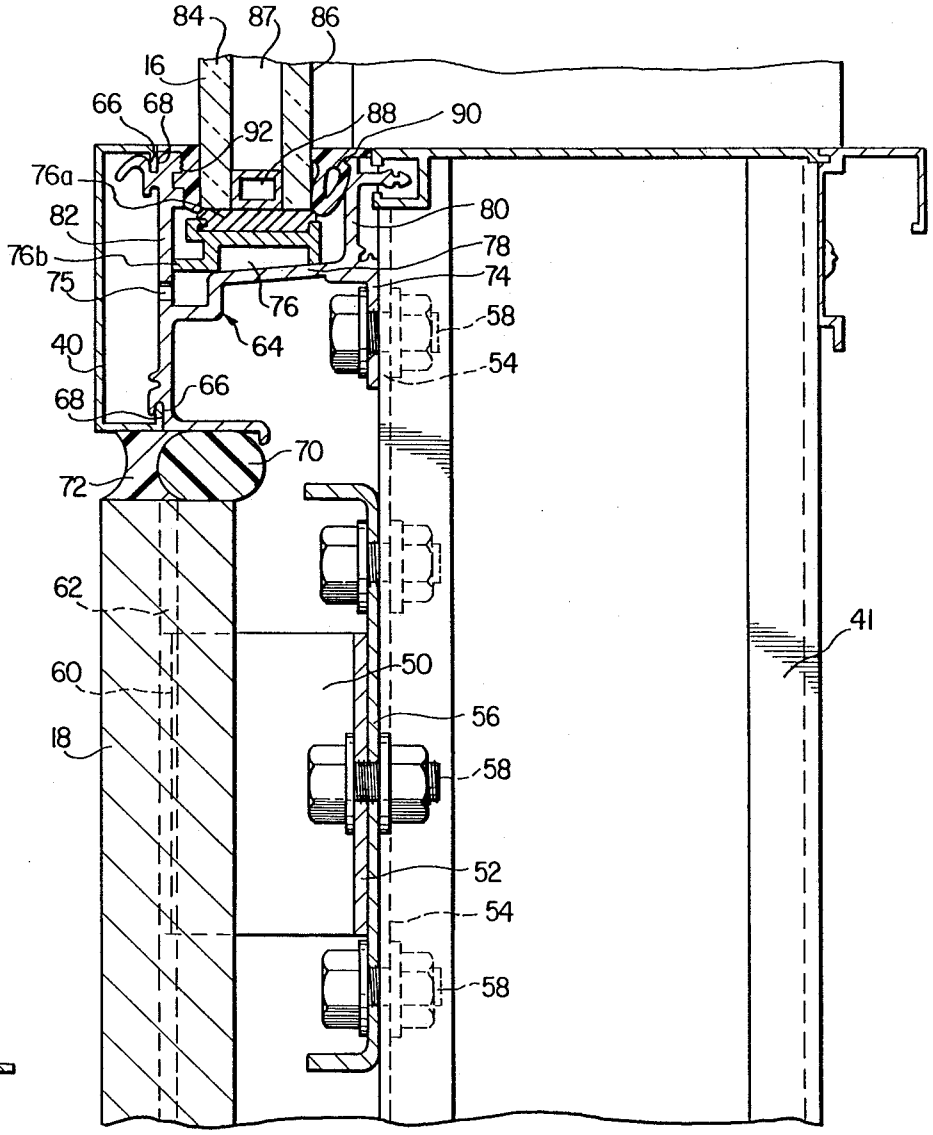
FIG. 4 is an enlarged, side-elevational, cross-sectional view of the curtain wall assembly of FIG. 1 taken along lines 4—4 thereof.

Still referring to FIG. 4, the granite panel 18 is secured adjacent the glass panel 16, in this particular embodiment, through an extruded aluminum mounting member 64. Mounting member 64 has formed therein a pair of ears 66 adapted for engaging lateral flange members 68 of the cap 40. Beneath the aluminum mounting member 64 an elastic sealing member 70 is provided with a sealant 72 molded outwardly thereof for complete sealing. The exact cross-sectional configuration of the mounting member 64 may vary, depending on application and method of support. In this particular embodiment the mounting member 64 includes a rear flange section 74 adapted for abutting engagement with the flange section 54 of the vertical steel mullion 41 for securement thereto with threaded fastener 58. It is important to note that this mounting is consistent with, and requires the same level of skill and training as, the mounting technique utilized to mount the granite panels 18. This consistency facilitates ease in assembly and efficiency in operation in the present invention. The glass panels 16 may thus be secured by an aluminum mullion which may be extruded in a conventional fashion but in a configuration adapted for securement to a vertical steel mullion 41. During installation of the curtain wall 10 the various tools necessary for assembly are thus reduced, which further reduces costs and increases efficiency. There are, of course, other design aspects incorporated in the horizontal mullion 64 which will be referred to herein.

Referring still to FIG. 4, a weep hole 75 is shown formed in the outer wall of the mullion 64. The weep hole 75 vents the inner chamber 76 formed therein. Chamber 76 is defined by lower mullion wall 78 inside wall 80, outside wall 82 and by the double pane glass assembly 16 shown herein. The double pane glass assembly 16 is comprised of a first outer pane 84 and an inner pane 86 which forms a dead air space 87 therebetween. A lower spacer 88 is disposed at the distal end of the glass panes 84 and 86 and together comprise the upper surface of the chamber 76. Setting block **76*a* and setting chair 76*b* are provided within chamber 76 to provide cushioning support for glass panes 84 and 86. Setting chair 76*b* is supported by lower mullion wall 78. In turn, setting block 76*a* is supported by setting chair 76*b* and the bottom edges of glass panes 84 and 86 are supported by setting block 76*a*. A conventional sealing member 90 formed of elastomeric material is shown disposed against inner glass pane 86 for purposes of sealing against therein. Likewise, an outer elastomeric sealing member 92 fabricated in a specific configuration for securement into and against outside wall 82 is shown herein for sealing said outer glass pane 84 against water infiltration. No matter how good such seals are, however, water infiltration does occur and therefore weep hole 75 is provided for such water accumulation in the horizontal mullion 64**.

Various prior art patents have addressed the importance of drainage systems and the role of the horizontal mullion in curtain wall systems for dealing with water infiltration. One such patent application Ser. No. 865,804 filed May 22, 1986, issued Sept. 27, 1988 as U.S. Pat. No. 4,773,193, and assigned to the assignee of the present invention, sets forth and shows such technology. Other references to the extruded, horizontal mullions such as mullions 64 shown in FIG. 4 will be addressed below. In each case the configuration of the mullion may vary for the specific application in the curtain wall. This is conventional in this art due to the particular applications of curtain wall systems. Both single pane, double pane and/or opaque panel members such as lightweight metal sections can be accommodated by the conventional extruded aluminum horizontal mullion. Various ones of these configurations wil be addressed as the specified sections of the curtain wall system 10 shown in FIG. 1 are addressed below. What should be noted is that as each section is addressed, these illustrations and explanations therefor are intended for purposes of enabling a man skilled in the art to construct the system 10 in accordance with the principles of the present invention. They are in no sense limiting to the spirit and scope of the present invention. A myriad of extruded aluminum horizontal mullion configurations can be contemplated and their association with rigid slab assemblies can thus provide enumerable combinations. Applicant has attempted to illustrate a sampling of these combinations for a complete presentation of the present invention.

Figure 3:
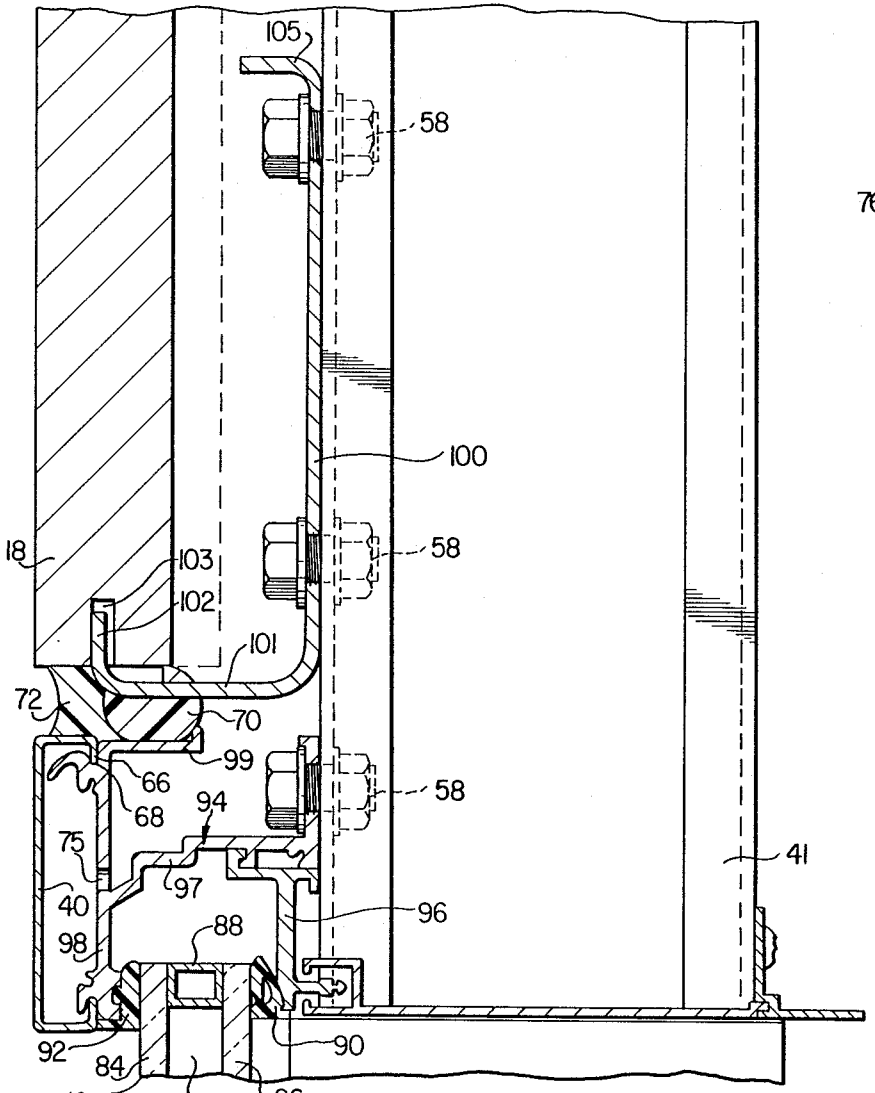
FIG. 3 is an enlarged, side-elevational, cross-sectional view of the curtain wall assembly of FIG. 1 taken along lines 3—3 thereof.

Referring now to FIG. 3, there is shown a side-elevational, cross-sectional view of the wall system 10 of FIG. 1 taken along lines 3—3 thereof. This section of the curtain wall system 10 illustrates the securement of a stone panel 18 above a glass panel 16. This particular configuration is the opposite of that described in FIG. 4 but further illustrates the manner of supporting the granite panel 18 across the lower surface thereof as well as means for securing and sealing the upper end of the glass panel installation 16. As described above, the glass panel assembly 16 is constructed with an outer glass pane 84 and an inner glass pane 86 defining the dead air space 87 therebetween. A spacer 88 is disposed on the upper end thereof while securing and sealing members 90 and 92 are disposed on opposite sides therearound. The sealing members 90 and 92 are elastomeric in construction and secure the glass panel installation 16 within a horizontal mullion 94 adapted for securing an underlying upper glass panel 16 with an outer cap 40 integrally formed therewith. It may be seen that the construction of the extruded aluminum horizontal mullion 94 adapted for receiving the outer cap 40 facilitates substantially contiguous interengagement with the lower region of the granite panel 18. The granite panel 18 is supported by a steel support clip 100 which is secured to the vertical steel mullion 41 by threaded fasteners 58. Likewise the horizontal aluminum mullion 94 is secured to the steel mullion 41 by threaded fastener 58. As set forth above, the securement of both the glass and the stone panels upon the vertical steel mullions 41 in the complementary fashion defined herein facilitates a vastly improved curtain wall system having the versatility of unlimited stone and glass panel configurations.

Still referring to FIG. 3, the horizontal extruded aluminum mullion 94 is but one example of the particular extrusion designs which are necessary in accordance with the principles of the present invention. The interface between granite and glass across both horizontal and vertical intersections requires a variety of securement, fastening and sealing configurations. The present horizontal mullion 94, for example, includes an inside wall 96, and outside wall 98 in which a weep hole 75 is formed above the top wall portion 97. The outside wall 98 further provides the necessary attachment region defined above for the cap 40 above which the sealant 72 is used for preventing water infiltration between the granite panel 18 and horizontal mullion region. An elastomeric sealing member 70 is shown disposed above the horizontal mullion 94 disposed above a top arm 99 thereof and beneath a lower flange 101 of the mounting clip 100. The mounting clip 100 as defined above is formed of steel and is secured to the vertical steel mullion 41 for support of the granite panel 18 and includes the lower outwardly extending flange 101 and upwardly extending flange section 102. Flange section 102 is adapted for receipt within a groove or curf 103 formed in the lower region of the panel 18. It should be noted that the particular support of the granite panel 18 by the generally C-shaped clip 100 is but one example of such a supporting configuration. The C-shaped clip 100 further includes a top flange 105 which is provided for enhancing the structural integrity thereof and other examples of support clips for securing the stone panels 18 in accordance with the principles of the present invention are provided below. In each case, the securement of the stone mounting clip will provide the face of the stone outwardly of the vertical steel mullion 41 in the requisite position which is generally flush with the outer surface of the cap 40, disposed outwardly of the outer surface of the outside glass pane 84. Consistency in this assembled configuration along the curtain wall system 10 is necessary for affording appropriate versatility. This versatility may be provided without the need for customized structural members or variations from accepted mounting and sealing techniques.

Figure 5:
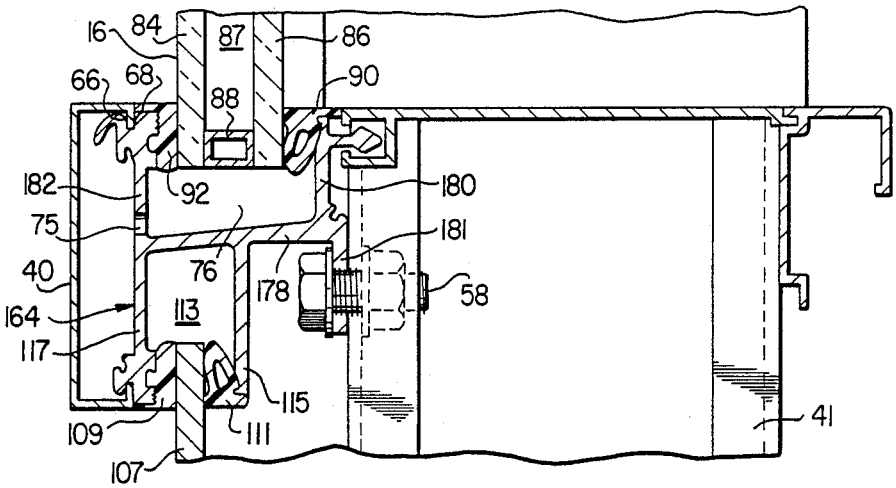
FIG. 5 is an enlarged, side-elevational, cross-sectional view of the curtain wall assembly of FIG. 1 taken along lines 5—5 thereof.

Referring now to FIG. 5 there is shown an enlarged, side-elevational, cross-sectional view of a section of the curtain wall 10 of FIG. 1 taken along the lines 5—5 thereof. In this particular view, the adjacent mounting of lightweight panels is illustrated. Upper glass panel installation 18 is thus disposed above a lower lightweight single panel member 107 which may be fabricated from metal, glass or the like. Panel member 107 is of the type conventionally used in curtain wall systems, having a realtively thin cross-sectional configuration and sufficiently light for mounting within a horizontal aluminum mullion. The requirements for steel clips and mounting members of the type described above and needed for securing the heavier stone panels 18 are not needed in this particular configuration. However, this variation is a very real part of the overall design configuration of the curtain wall system 10 of the present invention wherein any of a plurality of panel materials can be used.

Still referring to FIG. 5, the single mounting member is the extruded aluminum mullion 164. The horizontal mullion 164 comprises an inside wall 115 and outside wall 117 with intermediate flange region 178. Elastomeric sealing members 109 and 111 and the top region of panel 107 then define chamber 113 therewithin. The intermediate region 178 defines an upper chamber 76 which is further defined by inner wall 180 and outer wall 182 in which a weep hole 75 is formed. Elastomeric sealing members 90 and 92 and the lower edge of glass panel installation 16 thus comprises the topmost region of the inner chamber 76. A lower flange region 181 of sidewall 180 comprises the region upon which the threaded fastener 58 secures the horizontal mullion 164 to the vertical steel mullion 41 for securement of the upper glass panel and lower panel 107. Again it may be seen that the assembly incorporates the requisite drainage system necessary in such horizontal mullion systems conventional with glass panel installations.

Figure 6:
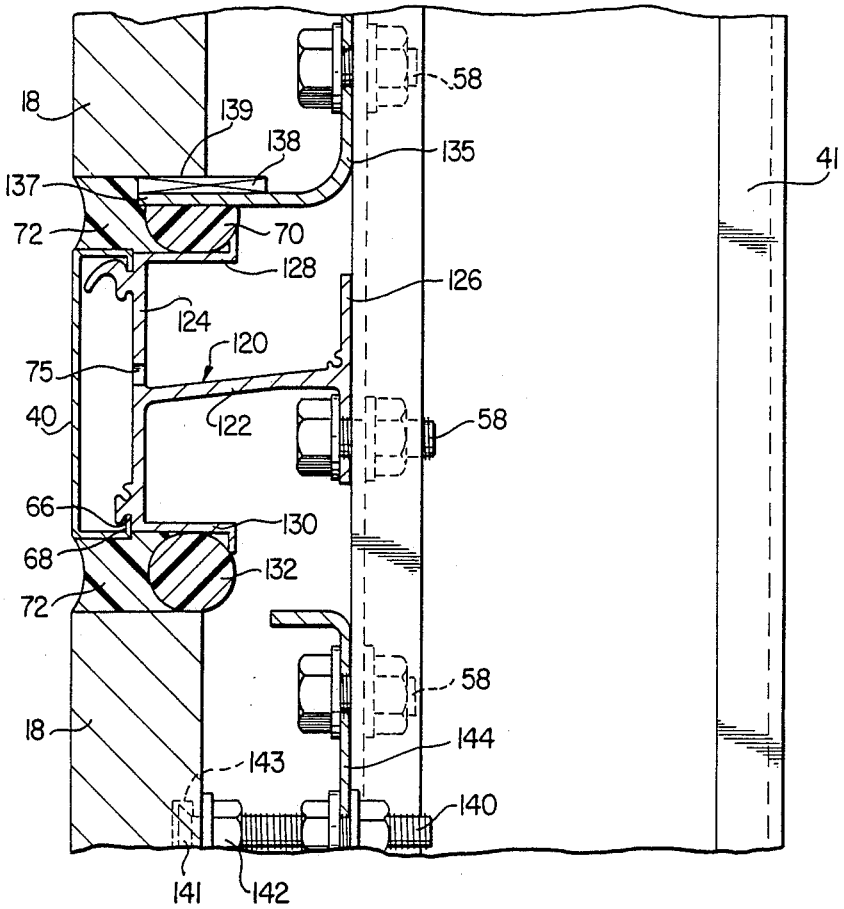
FIG. 6 is an enlarged, side-elevational, cross-sectional view of the curtain wall assembly of FIG. 1 taken along lines 6—6 thereof.

Referring now to FIG. 6, there is shown an enlarged side-elevational, cross-sectional view of a section of the curtain wall system of FIG. 1 taken along lines 6—6 thereof. In this particular embodiment the intersection of two adjacent stone panels 18 is illustrated with yet another means for securement of said stone panels to the vertical steel mullion 41. In this particular configuration a cap 40 is provided. This illustration shows the manner in which cap 40 is both fabricated and secured to the assembly and the manner in which it provides the sealing engagement between the adjacent stone panels 18—18.

Addressing first the intermediate cap 40, a horizontal aluminum mounting member 120 is provided having an intermediate arm 122 adapted for extending outwardly from vertical steel mullion 41. Arm 122 extends from a flange member 126 which is adapted for receiving the threaded fastener 158 therethrough for securement to said vertical steel mullion. An outside wall 124 is likewise formed in a configuration adapted for receiving the cap 40 thereon and with an aperture 75 formed therethrough for the drainage of any fluid which accumulates therein. Upper and lower flanges 128 and 130, respectively, are formed in generally parallel spaced relationship for affording structural rigidity to the horizontal strut 120. The flanges also facilitate sealed engagement between the upper and lower stone panels 18—18. A lower elastomeric sealing member 132 is thus provided between flange 130 and the upper surface of lower stone panel 18 with sealant 72 disposed outwardly therefrom into engagement with the lower region of the cap 40.

Mounting of the stone panels 18 is provided in the present embodiment with a slight variation to that described above. Mounting clip 135 is constructed with a lower flange 137 that is configured generally orthogonal thereto. A shim 138 is disposed thereon for supporting the bottom 139 of the tone panel 18. The steel clip 135 is likewise secured to the vertical steel mullion 41 by a threaded fastener 58 and sealed against water infiltration by sealant 72 disposed between cap 40 and the bottom 139 of panel 18. In this particular configuration, it may be seen that the heavy stone panels 18 are directly secured to the vertical steel mullion 41 by the use of steel clip 135. This configuration allows the utilization of the extruded aluminum mullion 120 which is also secured directly to the steel mullion 41 with the cap 40 disposed outwardly thereon.

Still referring to FIG. 6 there is shown the securement of the lower stone panel 18 adjacent the vertical steel mullion 41. In this particular configuration a support clip 144 is constructed for extending laterally relative to the vertical steel mullion 41 whereby a series of threaded members 140 may be positioned. The threaded members 140 are secured to the side regions of the support clip 144 which is secured to the vertical steel mullion 41 by a threaded fastener 58. The stone panel 18 is constructed with a slotted recess 143 as adapted for receiving the head 141 of the threaded fastener 140. A nut 142 is threaded thereon for adjusting the position of the panel 18 relative to the support clip 144. The use of the head 141 in a slot 143 for mounting of panels 18 is not unique in and of itself but is presented in conjunction with the present invention for illustrating the versatility of the current design.

Figure 7:
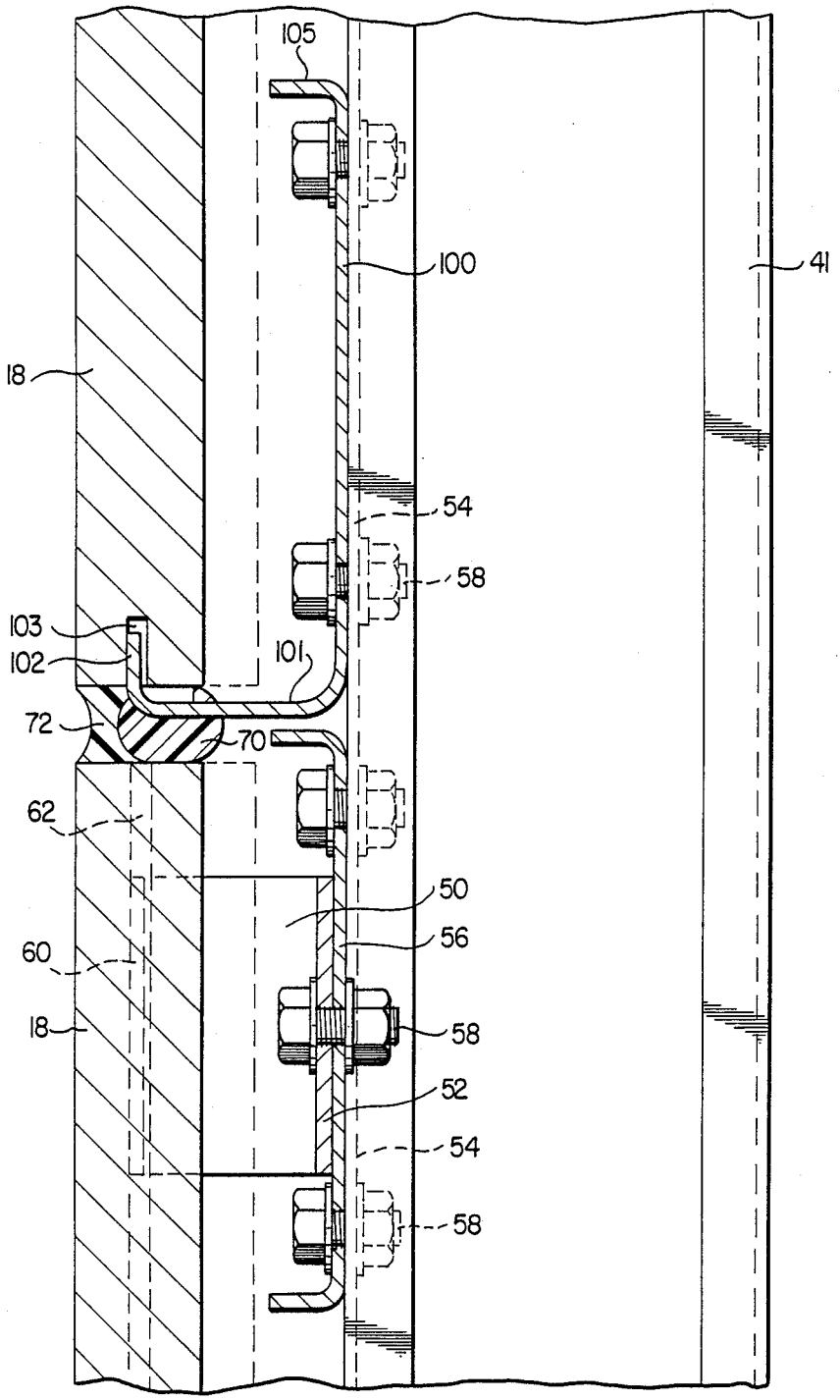
FIG. 7 is an enlarged, side-elevational, cross-sectional view of the curtain wall assembly of FIG. 1 taken along lines 7—7 thereof.

Referring now to FIG. 7 there is shown an enlarged, side-elevational, cross-sectional view of the curtain wall 10 of FIG. 1 taken along line 7—7 thereof. In this particular embodiment, the stone panels 18 are secured adjacent one another without the cap 40 disposed therebetween as seen in FIG. 6. In this particular configuration therefor, the horizontal aluminum mullion 120 has been eliminated and another embodiment for the mounting of the stone panels 18 in substantially contiguous relationship is shown and illustrated. A support clip 100 is thus utilized with a frontal flange 102 adapted for receipt within the curf or recess 103 of stone panel 18. The clip 100 is mounted upon the vertical steel beam 41 by threaded fasteners 58. A sealing member 70 and a sealing compound 72 is used to seal the opposed ends of the upper and lower stone panels 18 outside of the vertical steel mullion 41. In the present embodiment the lower stone panel 18 is secured by the C-shaped clip 50 which is mounted to the support clip 56 which is threadably secured to the vertical steel mullion 41. As described above, a groove or curf 62 is formed in the side wall of the stone panel 18 and is adapted for receipt of the flange 60. This securement adequately positions the stone panel 18 while allowing for movement from various dynamic and static loading.

Figure 8:
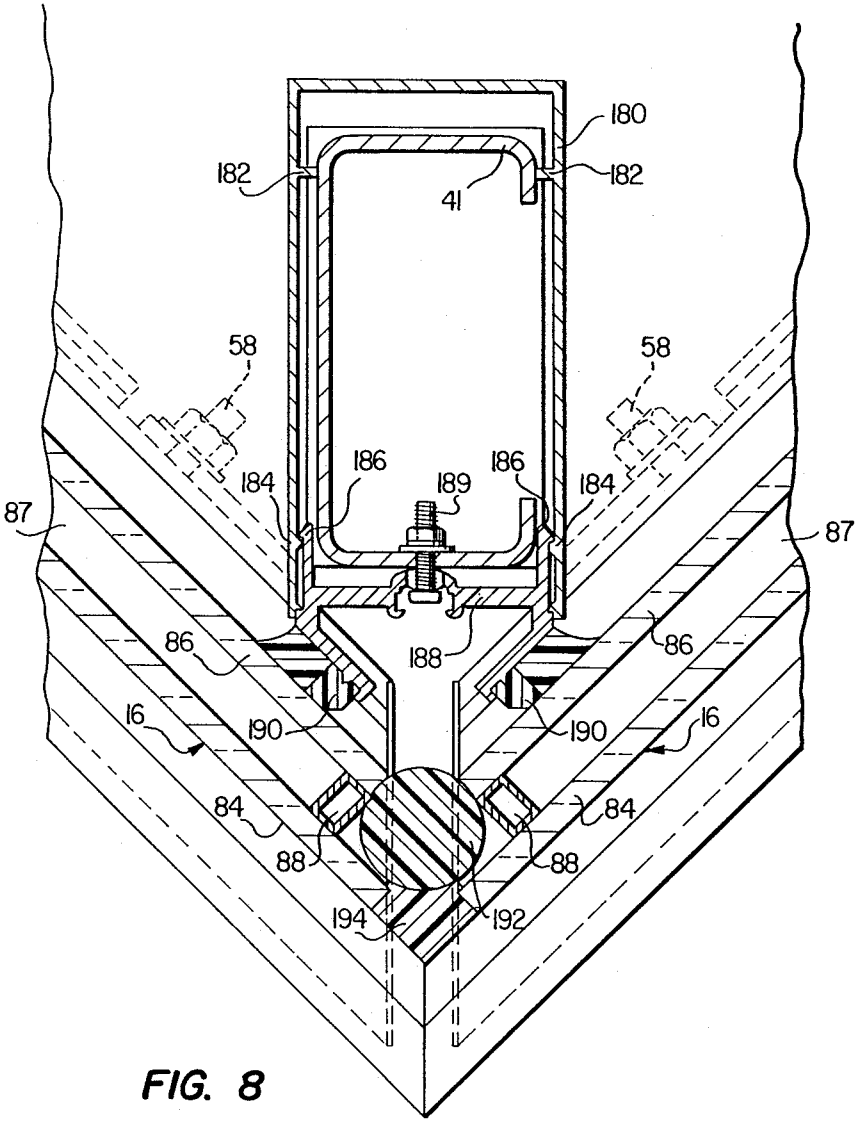
FIG. 8 is a top plan, cross-sectional view of a corner of the curtain wall assembly of FIG. 1 taken along lines 8—8 thereof.

Referring now to FIG. 8, there is shown an enlarged, top plan, cross-sectional view of the curtain wall system of FIG. 1 taken along the lines 8—8 thereof. In this view, glass panels 16 are installed adjacent one another at a right angle one to the other. This installation comprises the corner region of the curtain wall system 10 as seen in FIG. 1. The glass panels 16 are comprised of the outer glass pane 84, inner glass pane 86 and dead air space 87 therebetween. A spacer 88 is disposed between the separate glass panes as shown herein. Due to the corner positioning, the outer panes 84 are provided in a wider configuration for extending beyond the inside pane 86. A conventional sealing member 88 is provided between adjacent glass panels for sealing and a corner sealing strip 192 is likewise provided.

Still referring to FIG. 8, the vertical steel mullion 41 is shown to be covered by an extruded mullion cover 180 which is secured around the steel mullion. Standoffs 182 are formed on the inside body portion of the mullion cover 180 for centering the cover about the steel mullion 41. A pair of ears 184 is likewise disposed on the lower region thereof for engagement with seating flanges 186. The mounting clip 188 is secured to the vertical steel mullion 41 by a threaded fastener member 189 such as a hexhead cap screw. The clip 188 is further sealed against the inner glass pane 86 by a structural silicone sealant with silicone compatible spacer assembly 190. In this configuration the corner mullion is covered in an aesthetically pleasing fashion while providing ample sealed engagement with the glass panes. This is accomplished even though the steel mullion has irregularities which would ordinarily make it very difficult to cover. This will be addressed in more detail below (FIG. 10).

Other sealing members are incorporated in the assembly of FIG. 8 such as cylindrical corner sealing element 192. The cylindrical corner sealing element 192 is likewise formed of elastomeric construction for engaging the distal ends of the staggered edges of the glass panel assembly 16. A sealant 194 is used along the end, corner portion thereof for providing additional protection for the interior of the assembly and to prevent water infiltration. It should be noted that view of the corner is provided for the purposes of illustration only. A myriad of corner assembly techniques are possible in accordance with the principles of the present invention. A key feature is, however, the lazing adaptor of the present invention discussed below which allows for use of aluminum covers over the vertical steel mullions.

Figure 9:
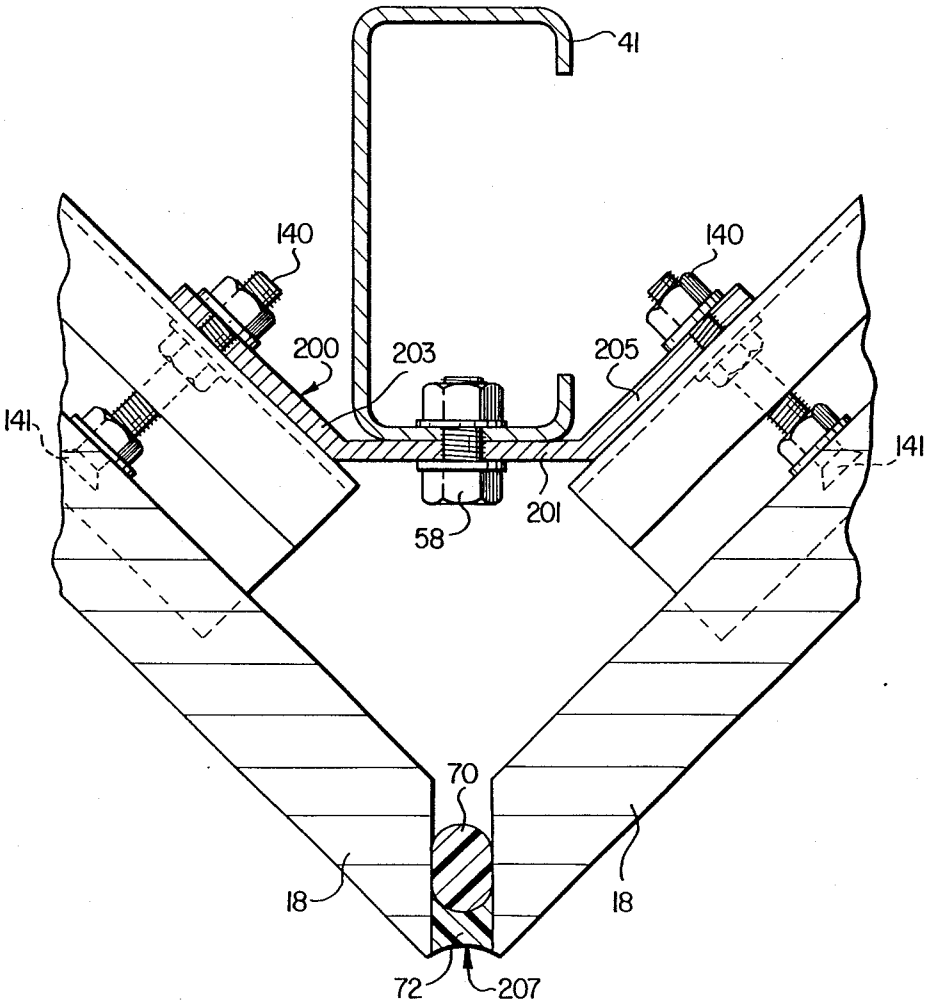
FIG. 9 is a top plan, cross-sectional view of a corner of the curtain wall assembly of FIG. 1 taken along lines 9—9 thereof.

Referring now to FIG. 9 there is shown an enlarged, top plan, cross-sectional view of the building of FIG. 1 taken along lines 9—9 thereof. Along this section of the building curtain wall 10 of FIG. 1, stone panels 18 intersect one another and are secured directly to the vertical steel mullion 41. The steel mullion 41 is secured to a mounting plate 200 having a first planar corner region 201 disposed intermediate of first lateral plate 203 and second lateral plate 205. First lateral plate 203 has mounted therethrough a threaded fastener 140 which is coupled into a recess in the stone panel 18 in the manner described above. Likewise the section 205 has a fastener member 140 secured therethrough for securement of a stone panel 18 adjacent thereto. Elastomeric spacer 70 and compatible silicone sealant 72 are utilized in stone corner region 207 for preventing water infiltration therein. Again, this is simply one illustration of a method of securing the corner regions of the stone in accordance with the principles of the present invention.

Figure 10:
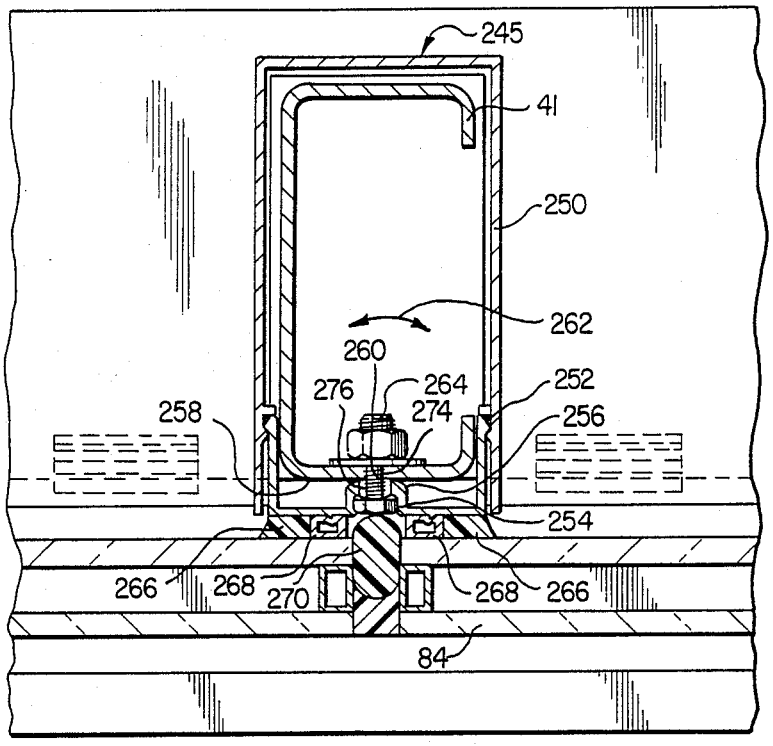
FIG. 10 is a top plan, cross-sectional view of a vertical steel mullion and glazing adaptor therefor.

Referring now to FIG. 10, there is shown the glazing adaptor 245 of the present invention which makes it possible to utilize an aluminum cover over the vertical steel mullions. As stated before, the vertical steel mullion system could very well be aluminum but steel is more rigid for a given size and consequently can meet design specifications in a more shallow section. In this way less aluminum is used. If a wall is to meet certain design specifications, for example 60 lbs. per square foot, the aluminum would in certain instances need to be on the order of 6 inches with a mullion cover on the order of 6¼ inches deep. A steel mullion can be of substantially less size, and in certain instances on the order of 1–1½ inches less. The present invention thus affords economic benefits by using less aluminum because of a shallower wall section. This can be appreciated in view of the number of times that the aforesaid length of mullion is used in a curtain wall assembly. The problem is, however, that manufacturing steel parts is more difficult than extruding aluminum profiles, because the flange of the steel part can either project "out" or "go in" relative to the wall. It is therefore difficult to get an aluminum cover over a steel mullion that wasn't fabricated to be specifically square. The present invention thus incorporates the glazing adapter 245 which makes it possible to use an aluminum cover an irregular steel part.

Still referring to FIG. 10, the vertical steel mullion 41 is housed by an aluminum cover 250 which is secured to a mounting clip 252. The clip 252 is constructed with a mounting head 254, the top 256 of which is arcuate in shape, as well as the bottom surface of the "double convex" section discussed in more detail below. The arcuate top 256 abuttingly engages the end 258 of the steel mullion 41 and is secured thereto by threaded fastener shown herein as a hexhead screw 260 which bears against the arcuate underside described relative to FIGS. 14, 15 and 16. This assembly permits a sufficient degree of pivoting of the cover 250 in the direction of arrow 262 to accommodate irregularities in the shape of the mullion 41. The relatively large bolt 264 is a structural securement bolt that would be seen in this particular top plan view and is not the extension of the threaded fastener 260. The glazing adapter 245 further includes the utilization of structural silicone sealant 266 contiguous glass spacers 268 which may be seen on opposite sides of the threaded mounting member 260 and beneath the mounting clip 252. The spacers 268 exert compression on the glazing adapter 245 imparting the tendency to make it become parallel to the glass in spite of irregularities that are in the vertical steel mullion 41. This accommodation is possible due to the arcuate top 256 of the mounting head 254 which bears against the underside 258 of the vertical steel mullion 241. Several degrees in misalignment may be accommodated therewith. Without the glazing adapter 245 such misalignment would ordinarily create serious problems in stool and head trim. The adapter 245, however, provides "apparent alignment" between the trim and the mullion cover, even when the vertical steel mullion 41 is crooked on the inside.

Mounting of the glazing adapter 245 to the steel mullion 241 is also accommodated by an orthogonal slot array. The mounting slot 274 in the mullion is complementary to the slot 276 in the adaptor and preferably orthogonal thereto. This orthogonal relationship is necessary because of the structural irregularities referred to above and the fact that the adaptor is aluminum while the mullion is steel and with different materials misalignment is almost a certainty. With the orthogonal slot arrangement, the glazing adaptor 245 may be utilized effectively for both alignment and sealing. Sealing is further provided with a silicone weather seal and backer rod 270.

Figure 14:
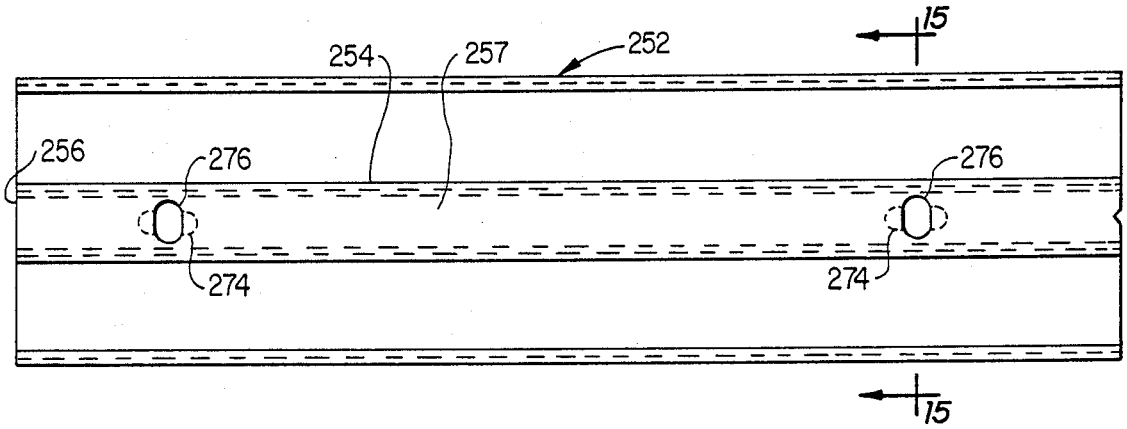
FIG. 14 is a plan view of the clip of the glazing adaptor of the present invention.

Referring now to FIG. 14, there is shown an enlarged plan view of the clip 252 of the glazing adaptor 245, the end elevation of which is shown in FIG. 10. It may be seen that the mullion engaging head 254 is comprised of an elongate section of the extruded clip 252. The top portion 256 of head 254 is arcuate in shape as described above and is further constructed with a convex underside surface 257. The double convexity of top surface 256 and bottom surface 257 creates a generally egg-shaped cross-section, herein referred to as a double convex region which will be described in more detail below. What is shown in the current figure is the elongate construction of the clip 252 with the elongated slots 276 formed therein. Each slot 276 is positioned in orthogonal relationship with the elongate slot 274 of the mullion described above. This orthogonal, or right angle configuration, is shown with the mullion slot 274 shown in phantom. In this particular inter-relationship, the slot's adjustability is afforded in combination with the double convexity of surfaces 256 and 257 contiguous thereto for affording benefits of the glazing adaptor 245 covering the vertical steel mullions described above.

Figure 15:
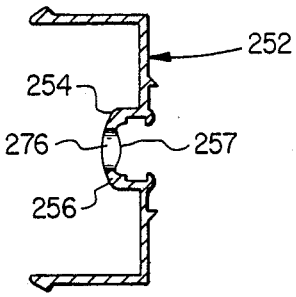
FIG. 15 is an end elevational, cross-sectional view of the glazing adaptor clip of FIG. 14 taken along lines 15—15 thereof.

Referring now to FIG. 15, there is shown an end elevational, cross-sectional view of the clip 252 taken along lines 15—15 thereof. The clip 252 is shown to be constructed with the double convex mounting head 254 with the slot 276 formed therethrough. The elongate construction of the slot 276 is shown most clearly in FIG. 15 with the unsectioned sides thereof appropriately shaded. This double convexity further facilitates the mounting of the fastening member and the engagement of the mullion shown most clearly in FIG. 10.

Figure 16:
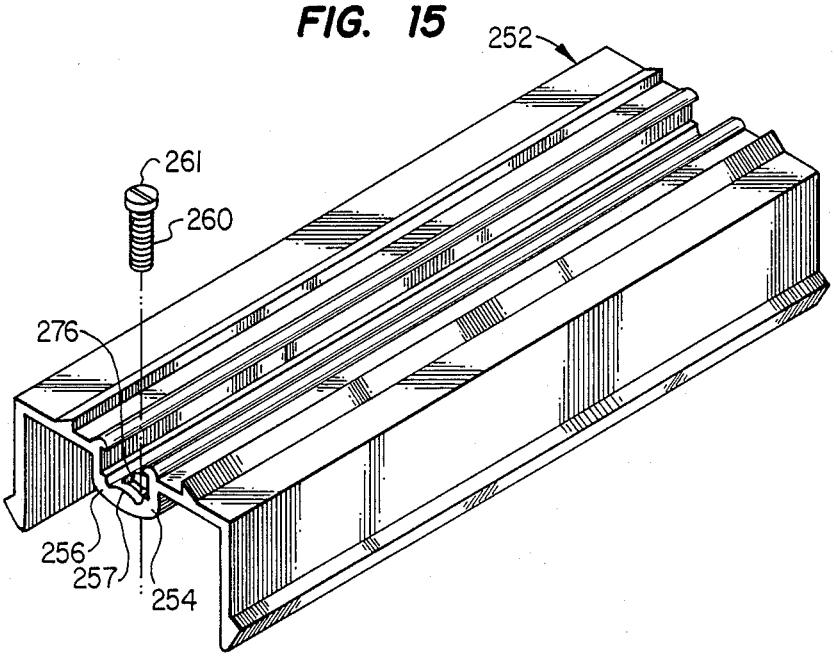
FIG. 16 is a perspective view of the glazing adaptor clip of FIG. 14 illustrating the receipt of a threaded fastener therein.

Referring now to FIG. 16, there is shown a perspective view of the clip 252 illustrating in more detail the construction of the elongate slots 276 formed therein. It may be seen that slot 276 is formed through the double-convex region defined between the top and bottom surfaces 256 and 257 of the mounting head 254. The actual construction of the clip 252 is shown in more detail in this perspective illustration and the threaded fastening member 260 is shown in an exploded view in alignment therewith. The head 261 of the threaded member 260 is, in this particular embodiment, not as wide as the slot 276 is long. However, it is wider than the slot 276 is wide and, thus, permits a secured, pivotal engagement therewith. (This aspect is shown most clearly in FIG. 8.) It may be seen that the head 261 of the threaded fastener 260 engages only the crest or top portion of the arcuate inside surface 257 of this double-convex region of the clip 252. In this manner, a pivotal mounting for the fastener head is established in conjunction with the pivotal mounting of the surface 256 engaging the steel mullion. Only in this manner, with the double-convex region defined between surfaces 256 and 257, will the glazing adaptor 245 be able to accommodate the irregularities in the steel mullion 41. Moreover, the orthogonal relationship of the slots 276 and 274 in the clip 252 and the mullion 41, respectively, enhance the maximum effectiveness of misalignment correction.

In this manner, it is possible to utilize an aluminum cover over the vertical steel mullion with accommodation of structural irregularities in a manner not heretofore possible.

Figure 11:
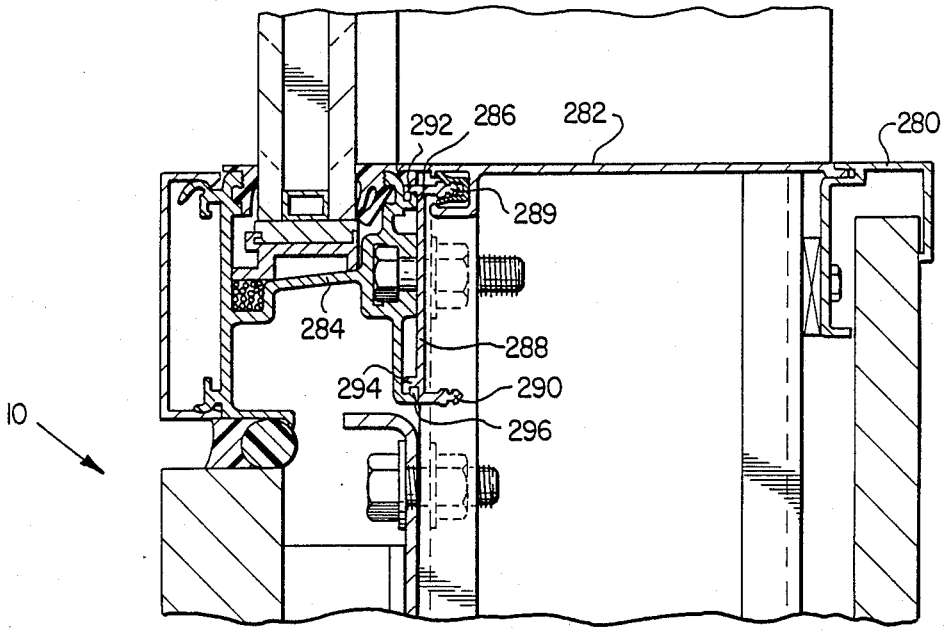
FIG. 11 is an enlarged side-elevational, cross-sectional view of the curtain wall assembly of FIG. 1 taken along lines 11—11 thereof.

Referring now to FIG. 11 there is shown the stool trim 280 and stool trim extension 282 which is coupled to a horizontal mullion 284. This particular view is incorporated for illustrating the utilization of a thermal isolator assembly in accordance with one aspect of the principles of the present invention. The overall assembly of the horizontal aluminum mullion 284 will not be described in any detail since the same is described above. What is not described is the utilization of the thermal flange 286 which comprises a separate, or discrete, part of the assembly. In conventional designs, thermal flanges are constructed as part of the horizontal mullion extrusion and the method of assembly is both time consuming and expensive. The thermal flange 286 comprises an intermediate planar body portion 288 having upper and lower flange regions 289 and 290, respectively. Upper and lower rear mounting legs 292 and 294 are also extruded with intermediate body section 288 for mounting with mounting flange portion 296 of the horizontal mullion 284. In this way, the thermal flange may be extruded as a discrete mounting element for attachment to the horizontal mullion 284 where necessary for mounting of the stool trim and trim extension 280 and 282. In conventional systems with the thermal flange extruded as a part of the horizontal mullion a great waste is created because only a small amount (on the order of 10–15%) of the thermal flange is used to connect to the stool trim. In present embodiment, the excess thernal flange is eliminated.

Figure 12:
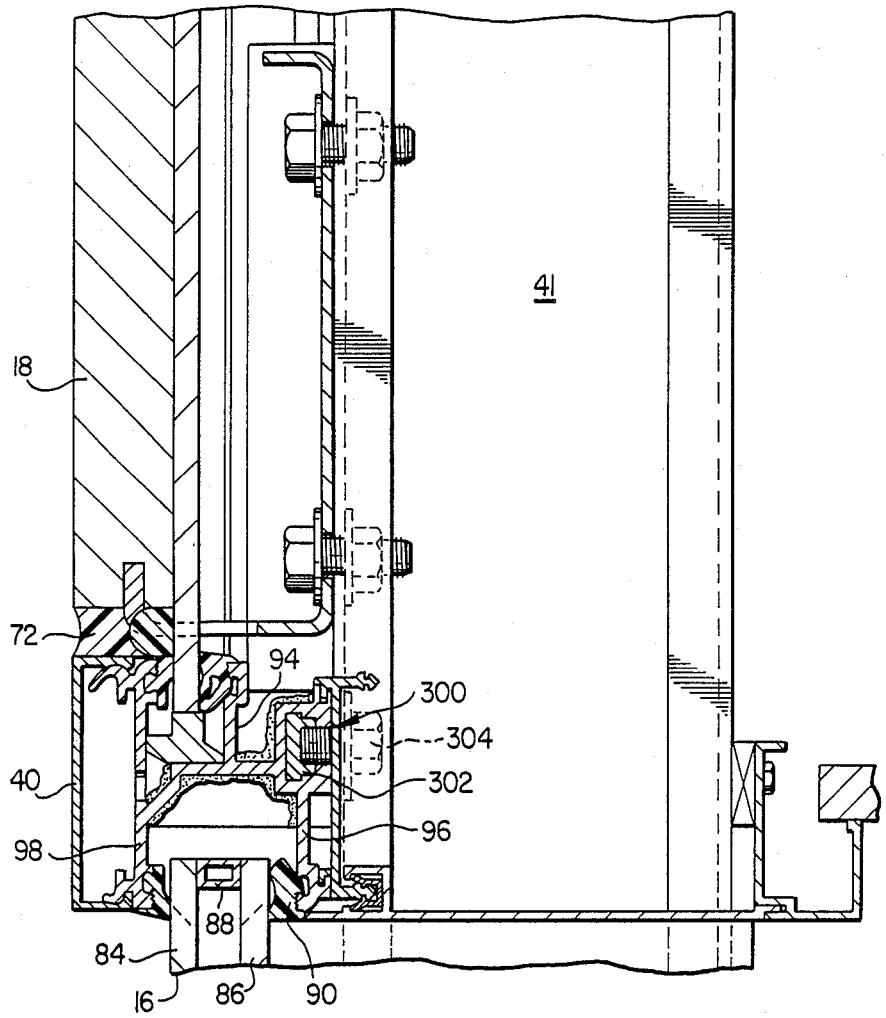
FIG. 12 is an enlarged, side-elevational, cross-sectional view of the curtain wall assembly of FIG. 1 taken along lines 12—12 thereof.

Referring now to FIG. 12 there is shown a side-elevational, cross-sectional view of the wall system 10 of FIG. 1 taken along lines 12—12 thereof and illustrating the utilization of a horizontal splice for the mounting thereof. As in FIG. 3 the section of the curtain wall ystem 10 illustrates the securement of a stone panel 18 above a glass panel 16. The glass panel assembly 16 is constructed with an outer glass pane 84 having a spacer 88 separating an inner glass pane 86. A horizontal mullion 94 is mounted to the vertical steel mullion 41 with an outer cap 40 mounted thereto. Again, the horizontal extruded mullion 94 is but one example of a particular extrusion design. This design does, however, permit the utilization of a horizontal splice. An inside wall 96 is formed in generally parallel spaced relationship with an outer outside wall 98, with the outside wall 98 further providing the necessary attachment region for the cap 40 above which sealant 72 is used preventing water infiltration. A T-splice mounting section 300 is formed along inside wall 96 wherein a T-shaped member 302 is utilized as a horizontal mullion splice in the form of a sliding member. Part of the purpose of this slide and the construction as defined herein is to permit thermal expansion of the wall in a manner permitting movement of adjacent horizontal mullions 94 toward each other of apart from on another. As shown herein, the T-shaped splice is secured to the vertical mullion 41 by means of a threaded bolt 304 which is explained in more detail below.

Figure 13:
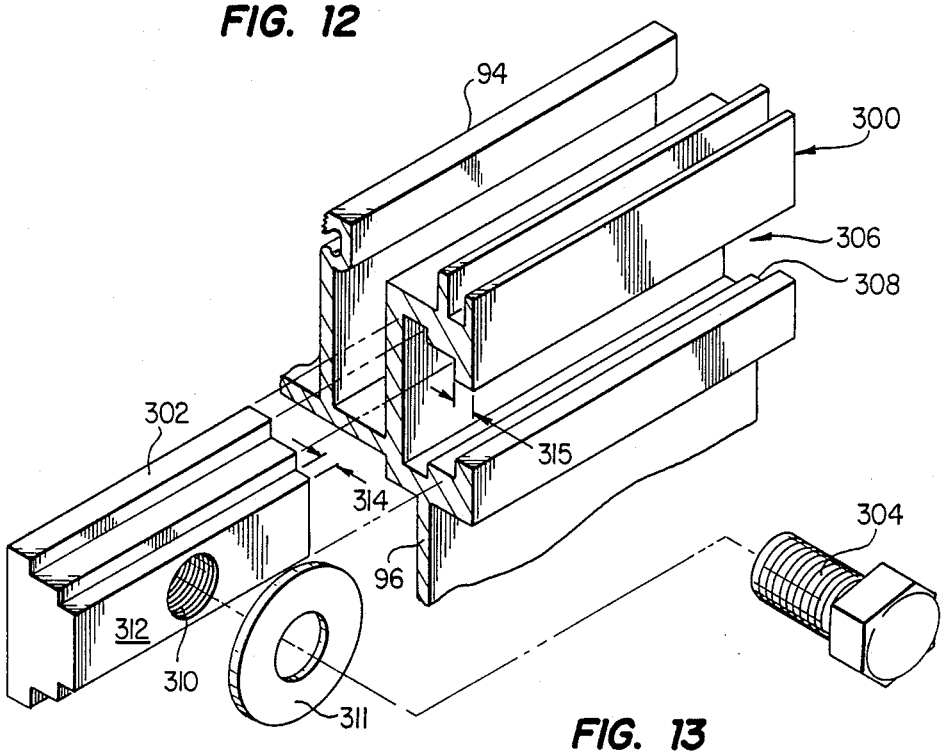
FIG. 13 is an enlarged, perspective, exploded view of a horizontal splice assembly constructed in accordance with the principles of the present invention.

Referring now to FIG. 13 there is shown an enlarged exploded perspective view of the horizontal splice 300 of FIG. 12. In this view, the horizontal mullion 94 is shown fragmentarily with the inside wall 96 partially cut away for purposes of illustration. What is shown is a channel section 306 formed in the inside wall 96 permitting mating entry of the slide 302. A T-splice channel 308 is constructed therein for mating engagement with the slide 302. A single threaded aperture 310 is provided in the T-splice slide 302 adapted for threaded receipt of the bolt 304. A washer 311 is provided for mounting therebetween. Of particular significance is the intermediate body portion 312 of the T-shaped slide 302 which has a dimension 314 slightly greater than the side wall dimension 315 of the channel 308. The dimension 314 of the intermediate body section 312 prevents the slide 302 from being tightened against the vertical mullion 41 in a manner restricting the movement of the mullions 94. In essence the intermediate body section 312 serves as an integral spacer in the horizontal T-shape splice, which spacer accommodates full movement and thermal expansion. With a stainless steel T-shape member 302 firmly attached to the steel mullion 41 by the bolt 304, there is a calculated space via the intermediate body portion 312 allowing expansion and contraction without creating additional stress. This aspect is critical for the versatility of the present invention. The single bolt assembly in a mullion whether aluminum or steel is superior to a two bolt assembly. When two holes are put into an asembly, from a structural view point the structure is significantly weakened because of loss of metal. Two bolt assemlies also have width restrictions where one bolt assemblies do not.

It has thus been shown that the utilization of glass panels 16 and/or stone panels 18 in a variety of arrays does not create a construction problem in tahe present invention. The vertical steel mullions 41 comprising a portion of steel framework 11 are utilized for both types of panels. When mounting steel panels 18 it is necessary to utilize a steel clip as described above. Where a vision area is provided as is shown in FIG. 8, the aluminum extrusion mullion cover 180 can be incorporated with the vertical mullion 41 without varying from the spirit and scope of the present invention. It is because the present invention incorporates a compatible inter-relationship between structural steel and lighter weight extruded aluminum that the present assembly can provide a low cost technique for assembling an intergrated stone and glass curtain wall system.

In fabrication, the steel framework 11 is constructed from a plurality of standard structural elements including the vertical steel mullion 41, formed steel support clip 10, side clip 50, underlying support clip 56. Each steel mullion and clip is adapted or utilization with a particular stone and/or stone glass configuration location and assembly. Likewise a plurality of extruded aluminum mullions can be provided in a standardized fashion whereby a wide variety of panel and glass assemblies can be incorporated. In this manner, an architect can address a curtain wall 10 with an array of interspersed sections of glass 16 and/or heavier stone 18 without imparting structural or assembly problems which necessitate a myriad of customized support configurations. As described herein, virtually all glass and stone panel configurations can be accommodated by the standardized assemblage of steel and aluminum elements incorporating the principle of the present invention. In the same vein, fastener members can be standardized such as the fasteners 58. A $\frac{3}{8}$ inch by $\frac{3}{4}$ hexhead nut bolt and washer has, for example, been found suitable for securement of mullions to support clips. Vertical mullions such as that shown herein have likewise been formed of steel in a $2'' \times 4'' \times \frac{1}{8}''$ configuration which provides adequate support for a wide variety of granite panels. Granite panels having a thickness on the order of $1\frac{1}{4}$–$1\frac{3}{4}$" have been supported by such configurations. The height of the granite panel 18 as well as the height of the glass 16 obviously depends on the particular design of the building. The utilization of slots or grooves, also known as curfs, in the stone are commonplace and thus are not deviations requiring customizing efforts relative to the present invention. Instead, the present invention accommodates existing structural considerations for both glass and panels in a compatible array. For example, weep holes 75 are provided in the horizontal aluminum mullions for affording egress of water which has inadvertently infiltrated the system. The utilizaion of a horizontal cap 40 between granite panels is in and of itself not novel but the specific incorporation as described herein is an advance over the prior art which normally necessitated the utilization of special assembly techniques for both securing the granite panels as well as providing space for securement of the cap. In the present invention the cap is but another element of the curtain wall system 10 which may be easily integrated into the system by straight forward design considerations. It is important to note, however, that the horizontal mullions between granite sections are not presented for structural support but as spacers therebetween. Such a configuration as that shown in FIG. 6 is a good example, whereby movement of the granite is afforded and ample elasticity is provided therebetween Direct granite over granite is not specifically shown in detail herein but is specifically comtemplated by the present invention. In such a configuration a granite support clip 100 or clip 135 would be utilized to support the adjacent granite panels with either a said clip 50 or a threaded mullion member inserted through a groove such as that shown in FIG. 6. Such tight thread mullion members have been used and have included 5 1/6 O.D. by $2\frac{1}{2}$" countersunk bolts, lock nut and washer assemblies which provide adequate spacing from the vertical mullion 41 and adequate support of the granite panel 18. It may likewise be noted that by utilizing such a system, glazing adaptors and mullion covers can be utilized in conjunction with the steel framework to provide the necessary aesthetic appearance often mandated by vision areas around glass panels 16. The design aspect allows the utilization of the more conventional, tested and commercially accepted sealing techniques such as structural silicone sealant with silicone compatible spacers. Again, customized sealing techniques are not necessary. The static and dynamic loading characteristics which are already well known as well as the thermal coefficients of expansion which have been experienced can be easily accommodated by the present invention. This is viewed in comparison to customized systems which are known to manifest certain idiosyncracies after installation. These idiosyncracies can be extremely critical to the integrity of the system either from the structural or from the sealing standpoint when variation from established norms are encountered. It can be seen that the present invention overcomes this problem by utilizing established construction techniques of both steel and alumunum in a configuration which accommodates the advantages of both in a standarized assembly.

It is thus believed that the operation and construction of the present invention will be apparent from the foregoing description. While the method and apparatus shown and described has been characterized as being preferred, it will be obvious that various changes and modifications may be made therein without departing from the spirit and scope of the invention as defined in the following claims.

What is claimed is:

1. A combination stone and glass curtain wall system comprising:

a structural wall section including a plurality of generally vertical steel mullions disposed one from the other in generally parallel spaced relationship;

a plurality of discrete, horizontal steel clips adapted for securement to said vertical steel mullions in generally parallel spaced relationship one to the other and in generally orthogonal relationship relative to said vertical steel mullions;

means for securing said descrete horizontal steel clips to said vertical steel mullions;

means associated with said discrete horizontal steel clips for securing said stone thereto;

a plurality of horizontal aluminum mullions adapted for securement to said vertical steel mullions in generally parallel spaced relationship one the other and in generally orthogonal relationship to said vertical steel mullions;

means for mounting said horizontal aluminum mullions to said vertical steel mullions;

said horizontal aluminum mullions being disposed adjacent to said discret horizonatal steel clips in generally parallel spaced relationship thereto for the securement of glass in direct association with stone supported thereby; and means for sealably securing said stone and said glass adjacent to one another in said curtain wall.

2. The curtain wall set forth in claim 1 wherein said means for sealably securing said stone and said glass adjacent one another includes a frontal face formed in said horizontal aluminum mullion adapted for receiving a cap thereacross, said cap being disposed in relatively flush, edgewise, abutting engagement withsaid stone and secured to said mullion securing said glass therein.

3. The curtain wann set forth in claim 2 wherein said horizontal aluminum mullion comprises at least one hollow region therein for the collection of water and the elimination of said water therethrough, and wherein said frontal face is constructed with at least one aperture permitting the drainage of water therefrom.

4. The curtain wall set forth in claim 2 wherein said sealant means comprises an elastomeric sealant bonded directly of an edge of said granite into an edge of said horizontal aluminum mullion.

5. The curtain wall set forth in claim 1 wherein said horizontal aluminum mullions and said horizontal supporting clips are secured to said vertical steel mullions by a plurality of bolts extending therethrough.

6. The curtain wall set forth in claim 1 wherein said horizontal aluminum mullions comprise an outer facial region adapted for receiving a cap thereagainst and further including means for sealably securing said stone sections to said horizontal aluminum mullion.

7. The curtain wll as set forth in claim 1 and further including a generally T-shaped splice adapted for mating engagement with said horizonatal aluminum mullions and the securement of said horizontal aluminum mullions to said vertical steel mullions.

8. The curtain wall as set forth in claim 7 wherein said generally T-shaped splice is constructed with at least one aperture therein and having an intermediate body region with the dimension slightly greater than the dimension of said horizontal aluminum mullion adapted for the receipt thereof whereby said intermediate body region extends therethrough to permit sliding engagement of said horizontal aluminum mullions thereupon subsequent to securement of said T-splice to said vertical steel mullions.

9. The curtain wall set forth in claim 1 further comprising:

a glazing adaptor constructed fora pivotal securement to said vertical steel mullions; and a hollow mullion cover, said mullion cover being said vertical steel mullions and accommodating for any irregularities formed therein to present an appearance of aligned manufacture.

10. The curtain wall set forth in claim 9 wherein said glazing adaptor is constructed with an intermediate mounting member having a curved top portion with an aperture formed therethrough, said curved top portion comprising the top surface of a double-convex region adapted or abuttingly engaging said vertical mullion and for receipt of a fastener member therethrough for securement to said vertical mullion and pivotal securement thereagainst in accommodation of irregularities therein.

11. The curtain wall set forth in claim 10 wherein said means for sealably securing said stone and said glass adjacent one another includes a frontal face formed in said horizontal aluminum mullion adapted for receiving a cap thereacross, said cap being disposed in relatively flush, edgewise, abutting engagement with said stone and secured tao said mullion securing said glass therein.

12. The curtian wall set forth in claim 11 wherein said horizontal aluminum mullion comprises at least one hollow region therein for the collection of water and the elimination of said water therethrough, and wherein said frontal face is constructed with at least one aperture permitting the drainage of water therefrom.

13. The curtain wall set forth in claim 11 wherein said sealant means comprises an elastomeric sealant bonded directly to an edge of said granite into an edge of said horizontal aluminum mullion.

14. The curtain wall as set forth in claim 10 and further including a generally T-shaped splice adapted for mating engagement with said horizontal aluminum mullions and the securement of said horizontal aluminum mullions to said vertical steel mullions.

15. The curtain wall as set forth in claim 14 wherein said generally T-shaped splice is constructed with at least one aperture therein and having an intermediate body region with the dimension slightly greater than the dimension of said horizontal aluminum mullion adapted for the receipt thereof whereby said intermediate body region extends therethrough to permit sliding engagement of said horizontal aluminum mullions thereupon subsequent to securement of said T-splice to said vertical steel mullions.

16. An improved method of manufacturing a glass and stone curtain wall of the type wherein both glass and stone panels are secured to a common curtain wall with said glass panels being disposed adjacent said stone panels in at least one select area thereof, wherein the improvement comprises the steps of:

providing a structural framework including a plurality of vertical steel mullions disposed in generally parallel spaced relationship one from the other;

providing a plurality of horizontal steel clips adapted for securement to said vertical steel mullions and the support of said stone panels;

securing said horizontal steel clips to said vertical steel mullions;

providing a plurality of horizontal aluminum mullions adapted for securement to said vertical steel mullions and the support of said glass panels;

securing said horizontal alumunum mullions to sid vertical steel mullions in generally parallel spaced relationship and in an orientation generally orthogonal to said vertical steel mullions;

mounting said stone panels to sid horizontal steel clips; and mounting said glass panels to said horizontal aluminum mullions.

17. The method as set forth in claim 16 and further including the step of forming said horizontal aluminum mullions with at least one water collection area adapted for accumulating water infiltration from said curtain wall and forming at least one aperture in said horizontal mullion for the drainage of said water therefrom.

18. The method as set forth in claim 16 and further including the step of providing a plurality of relatively short, steel support strips adapted for seurement to said vertical steel mullions, securing said strips to said vertical steel mullions, providing a plurality of generally C-shaped steel clips adapted or securing said stone panels, securing said C-shaped clips to outer portion of said relatively short strip secured to said vertical steel mullions and securing said stone panels thereto.

19. The method as set forth in claim 16 and further including the steps of grooving the side walls of sid stone panels with slotted regiosn adapted for receiving a portion of said steel clips and inserting said steel clips into said slotted portion of said granite panels in the securement thereof to said curtain wall.

20. The method as set forth in claim 16 and further including the steps of:

providing a plurality of generally C-shaped support clips adapted for being disposed beneath said stone panels and engaging said panels for securement;

grooving a lower edge of said stone panel for receipt of said steel clip;

securing said steel clip to said steel mullion;

resting said stone panel upon said steel clip with said groove thereof in receipt of the portion of said steel clip;

securing a horizontal aluminum mullion adjacent to and beneath said steel clip in spaced relationship therefrom;

providing an elastomeric sealant adapted for sealing said panels; and filling said space between steel clip and said horizontal aluminum mullion with said elastomeric sealant to seal said curtain wall from water intrusion.

21. The method as set forth in claim 16 and further including the steps of:

providing a glazing adaptor and a fastener member for pivotal securement of said adaptor to said vertical steel mullions;

providing a hollow mullion cover adapted for securement to said glazing adaptor for covering said vertical steel mullions and accommodating for any irregularities formed therein to present an appearance of aligned manufacture; and constructing said glazing adaptor with an intermediate mounting member having a curved top portion with an aperture formed therethrough, said curved top portion comprising the top surface of a double-convex region adapted for abuttingly engaging said vertical mullion and for receipt of said fastener member therethrough for securement to said vertical mullion and pivotal securement there against for

* * * * *

UNITED STATES PATENT AND TRADEMARK OFFICE

CERTIFICATE OF CORRECTION

PATENT NO. : 4,899,508

DATED : February 13, 1990

INVENTOR(S) : Biebuyck

It is certified that error appears in the above-identified patent and that said Letters Patent is hereby corrected as shown below:

| | |
|---|---|
| Column 1, line 16 | after "lack of"<br>insert --a-- |
| Column 1, line 21 | delete "techiniques"<br>insert --techniques-- |
| Column 2, line 11 | delete "safelyu withsatand"<br>insert --safely withstand-- |
| Column 3, line 44 | delete "genrally"<br>insert --generally-- |
| Column 8, line 56 | delete "wil"<br>insert --will-- |
| Column 15, line 39 | delete "ystem"<br>insert --system-- |
| Column 15, line 58 | delete "of"<br>insert --or-- |
| Column 16, line 26 | delete "assemlies"<br>insert --assemblies-- |
| Column 16, line 30 | delete "tahe"<br>insert --the-- |
| Column 16, line 47 | delete "10"<br>insert --100-- |
| Column 16, line 48 | delete "or"<br>insert --for-- |

UNITED STATES PATENT AND TRADEMARK OFFICE

CERTIFICATE OF CORRECTION

PATENT NO. : 4,899,508

DATED : February 13, 1990

INVENTOR(S) : Biebuyck

It is certified that error appears in the above-identified patent and that said Letters Patent is hereby corrected as shown below:

| | |
|---|---|
| Column 16, line 61 | delete "principle"<br>insert --principles-- |
| Column 17, line 34 | delete "said"<br>insert --side-- |
| Column 17, line 62 | delete "alumunum"<br>insert --aluminum-- |
| Column 17, line 63 | delete "standarized"<br>insert --standardized-- |
| Column 18, line 15 | delete "descrete"<br>insert --discrete-- |
| Column 18, line 27 | delete "discret horizonatal"<br>insert --discrete horizontal-- |
| Column 18, line 38 | delete "withsaid"<br>insert -- with said-- |
| Column 18, line 40 | delete "wann"<br>insert --wall-- |
| Column 18, line 48 | delete "directly of an edge"<br>insert --directly to an edge-- |
| Column 18, line 59 | delete "wll"<br>insert --wall-- |

UNITED STATES PATENT AND TRADEMARK OFFICE

CERTIFICATE OF CORRECTION

PATENT NO. : 4,899,508

DATED : February 13, 1990

INVENTOR(S) : Biebuyck

It is certified that error appears in the above-identified patent and that said Letters Patent is hereby corrected as shown below:

| | |
|---|---|
| Column 18, line 61 | delete "horizonatal"<br>insert --horizontal-- |
| Column 19, line 8 | delete "fora"<br>insert --for-- |
| Column 19, line 10 | after "cover being"<br>insert --adapted for securement to said glazing adapter for converting-- |
| Column 19, line 19 | delete "or"<br>insert --for-- |
| Column 19, line 30 | delete "tao"<br>insert --to-- |
| Column 19, line 31 | delete "curtian"<br>insert --curtain-- |
| Column 20, line 4 | delete "alumunum"<br>insert --aluminum-- |
| Column 20, line 4 | delete "sid"<br>insert --said-- |
| Column 20, line 8 | delete "sid"<br>insert --said-- |
| Column 20, line 15 | delete "inflitration"<br>insert --infiltration-- |

UNITED STATES PATENT AND TRADEMARK OFFICE

CERTIFICATE OF CORRECTION

PATENT NO. : 4,899,508

DATED : February 13, 1990

INVENTOR(S) : Biebuyck

It is certified that error appears in the above-identified patent and that said Letters Patent is hereby corrected as shown below:

Column 20, line 20 delete "seurement"
insert --securement--

Column 20, line 22 delete "or"
insert --for--

Column 20, line 27 delete "sid"
insert --said--

Column 20, line 28 delete "regiosn"
insert --regions--

Column 20, line 47 after "space between"
insert --said--

Column 20, line 67 after "for"
insert --accommodation of irregularities therein--

Signed and Sealed this

Seventeenth Day of December, 1991

*Attest:*

HARRY F. MANBECK, JR.

*Attesting Officer*

*Commissioner of Patents and Trademarks*